US009180991B2

(12) United States Patent
Dupont et al.

(10) Patent No.: US 9,180,991 B2
(45) Date of Patent: Nov. 10, 2015

(54) APPARATUS AND METHOD FOR PACKAGING A LIQUID PRODUCT

(75) Inventors: Laurent Dupont, Renescure (FR); Stéphane Gauthier, Renescure (FR)

(73) Assignee: BONDUELLE, Renescure (FR)

( * ) Notice: Subject to any disclaimer, the term of this patent is extended or adjusted under 35 U.S.C. 154(b) by 645 days.

(21) Appl. No.: 13/519,416

(22) PCT Filed: Sep. 19, 2011

(86) PCT No.: PCT/FR2011/000506

§ 371 (c)(1),
(2), (4) Date: Aug. 17, 2012

(87) PCT Pub. No.: WO2012/038616

PCT Pub. Date: Mar. 29, 2012

(65) Prior Publication Data

US 2012/0297732 A1 Nov. 29, 2012

(30) Foreign Application Priority Data

Sep. 20, 2010 (FR) ..... 10 03724

(51) Int. Cl.
*B65B 31/02* (2006.01)
*B65B 3/18* (2006.01)
*B67C 3/22* (2006.01)

(52) U.S. Cl.
CPC ..... *B65B 31/025* (2013.01); *B65B 3/18* (2013.01); *B67C 3/222* (2013.01)

(58) Field of Classification Search
CPC ..... B67C 3/223; B67C 3/222; B65B 3/18; B65B 31/028; B65B 31/027; B65B 31/025; B65B 31/02
USPC ..... 53/403, 408, 432, 79, 86, 88, 110, 510
See application file for complete search history.

(56) References Cited

U.S. PATENT DOCUMENTS 1,168,695 A * 1/1916 Young ..... 426/397
2,810,652 A * 10/1957 Armbruster ..... 53/408

(Continued)

FOREIGN PATENT DOCUMENTS

DE 1910548 A1 * 9/1970 ..... B67C 3/222
DE 2520403 B1 * 8/1976 ..... B67C 3/222

(Continued)

OTHER PUBLICATIONS

International Search Report, dated Jan. 2, 2012, from corresponding PCT application, PCT/FR2011/000506, 3 pages.

*Primary Examiner* — Stephen F Gerrity
(74) *Attorney, Agent, or Firm* — Young & Thompson

(57) ABSTRACT

The invention relates to a method for packaging a liquid product (1), such as a food product, and, in particular, a product sensitive to oxygen, in a container (2) with a low oxygen content, said container including an opening (3). The method of the invention comprises the following steps: the air is removed from the container by filling same to capacity with the liquid product in a non-controlled atmosphere; the full container is placed in a non-oxidizing atmosphere formed by at least one non-oxidizing gas; the liquid product is partially emptied from the container in a non-oxidizing atmosphere, such that the at least one non-oxidizing gas replaces the product discharged from the container; and the above-mentioned container opening is closed in a gas-tight manner while the container is partially full of the liquid product in a non-oxidizing atmosphere.

14 Claims, 1 Drawing Sheet

(56) References Cited

U.S. PATENT DOCUMENTS

| | | | | |
|---|---|---|---|---|
| 3,477,192 | A | 11/1969 | Brown et al. | |
| 3,674,060 | A * | 7/1972 | Ruekberg | 141/83 |
| 3,837,137 | A * | 9/1974 | Yatsushiro et al. | 53/432 |
| 4,487,237 | A * | 12/1984 | Sick et al. | 141/39 |
| 4,926,613 | A | 5/1990 | Hansen | |
| 4,977,723 | A * | 12/1990 | Dubrulle et al. | 53/110 |
| 6,457,299 | B1 | 10/2002 | Schwenke et al. | |
| 2003/0230055 | A1 * | 12/2003 | Yasuhira | 53/512 |
| 2007/0107384 | A1 * | 5/2007 | Capelli et al. | 53/432 |
| 2008/0156391 | A1 * | 7/2008 | Behar | 141/2 |
| 2008/0232721 | A1 | 9/2008 | Michalsky | |
| 2008/0256902 | A1 * | 10/2008 | Lorcks et al. | 53/425 |
| 2012/0308699 | A1 * | 12/2012 | Dupont et al. | 426/397 |

FOREIGN PATENT DOCUMENTS

| | | | | |
|---|---|---|---|---|
| DE | 31 44 854 | A1 | 8/1982 | |
| DE | 3514846 | A1 * | 11/1985 | B65B 31/02 |
| DE | 19920761 | C1 * | 6/2000 | B67C 3/223 |
| DE | 10240933 | A1 * | 3/2004 | B67C 3/223 |
| FR | 2 826 948 | A1 | 1/2003 | |
| WO | 2007/022825 | A1 | 3/2007 | |
| WO | WO 2007039358 | A1 * | 4/2007 | B65B 31/025 |

* cited by examiner

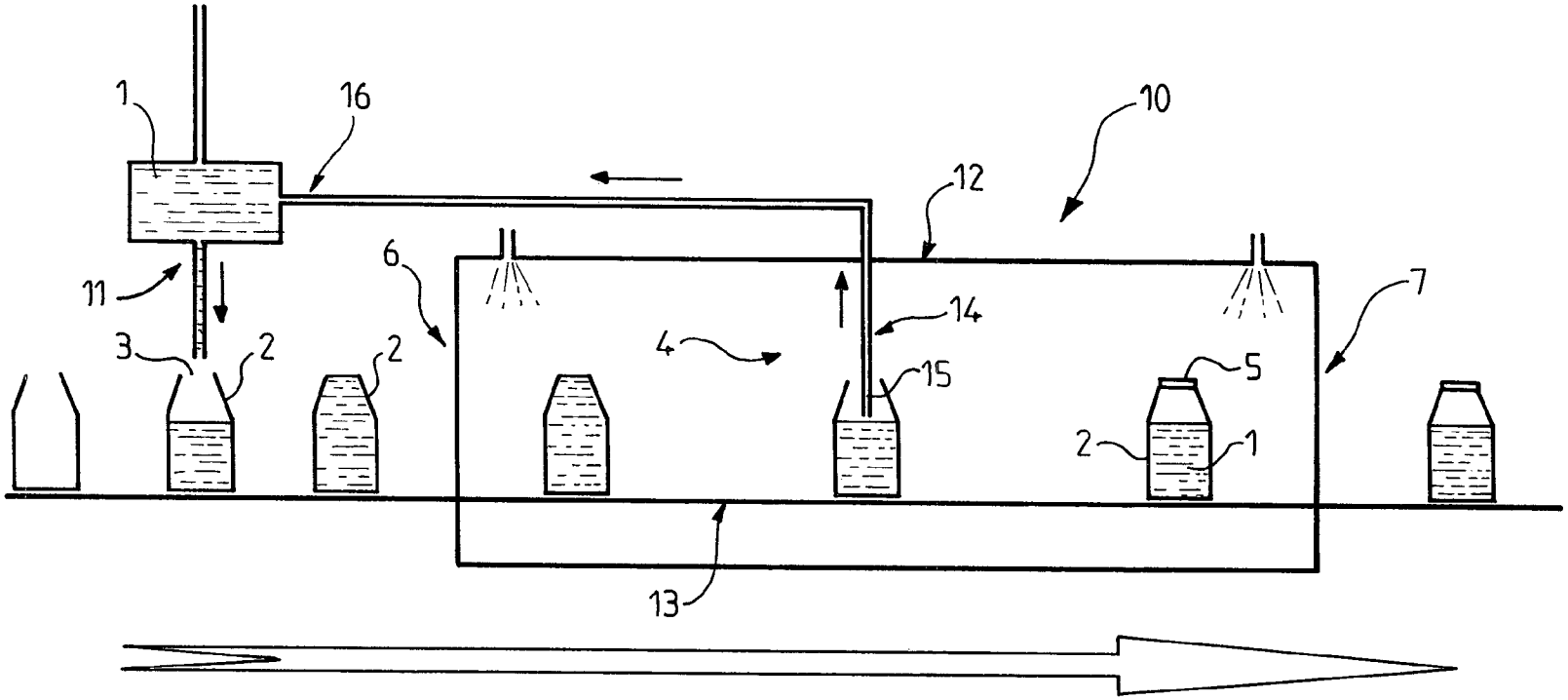
10
12
14
15
7
5
1
2
4
13
6
2
16
2
1
11
3

APPARATUS AND METHOD FOR PACKAGING A LIQUID PRODUCT

FIELD OF THE INVENTION

The invention relates to a method for packaging a liquid product and will find particular application, but is not restricted to, the packaging of food products.

BACKGROUND OF THE INVENTION

In the field of food, methods of inerting are known which make it possible to package products that are sensitive to oxygen in a container with a low oxygen content.

In the case with liquid products intended to be packaged in a container with limited headspace (low volume of air between the opening of the container and the liquid contained), the method generally implemented industrially consists substantially in metering a drop of liquid nitrogen in the container on said headspace, then, when the air has been removed by the nitrogen passing to a gaseous state, in closing in a gas-tight manner the opening of the container.

The difficulty in implementing such a method resides substantially in the proper metering of the drop of nitrogen, as well as in the timing of the step of closing.

For example, an over-metering of the drop of nitrogen, or the closing of the container too early, can result in an internal pressure in the container that is too high, rendering fragile and even deteriorating the container.

On the contrary, if the step of closing is too late, air will re-enter said headspace and the packaging will be defective.

SUMMARY OF THE INVENTION

The purpose of this invention is therefore to propose a method of packaging a liquid product in a container with a low oxygen content, which overcomes the aforementioned disadvantages, making it possible in particular to control the internal pressure in the container.

Another purpose of this invention is to propose a method which can be carried out in a continuous production line.

Other purposes and advantages of this invention shall appear in the following description which is provided for the purposes of information only and of which the purpose is not to restrict it.

As such the invention relates to a method for packaging a liquid product, in particular a food product, in particular sensitive to oxygen in a container with a low oxygen content, said container having an opening, characterised in that said method comprises the following steps:

- the air is removed from the container by filling same to capacity with a liquid in a non-controlled atmosphere (ambient air),
- the full container is placed in a non-oxidising atmosphere formed by at least one non-oxidising gas,
- the liquid product is partially emptied from the container in a non-oxidising atmosphere, in such a way that said at least one non-oxidising gas replaces said product discharged from the container,
- said opening of the container is closed in a gas-tight manner, partially filled with said liquid product in a non-oxidising atmosphere.

According to optional characteristics taken alone or in combination:

- the step of emptying the liquid is carried out by suction;
- said emptying liquid is recycled as a filling liquid;
- the method is carried out on a continuous production unit;

- the step of closing said opening of the container in a gas-tight manner is carried out by the putting into place of a closure, such as a lid or a stopper;
- the container can be a metal tin such as for example a tin can, a bottle made of glass, plastic or any other material;
- the liquid product is a food product such as a beverage, sauce, juice, soup, broth or other liquids, etc.

The invention further relates to a unit for the packaging of liquid products, in particular those sensitive to oxygen in a container with a low oxygen content on a continuous production line, said container having an opening, said unit comprising according to the direction of forward movement of the containers, successively:

- means for filling the container with said liquid product to capacity in a non-controlled atmosphere,
- a chamber in a non-oxidising atmosphere, filled with an inert gas, said chamber being provided with means of conveying allowing for the forward movement of said containers, said chamber receiving a device for emptying containers via suction,
- a device for closing the opening of said container in a gas-tight manner, internal to said chamber.

According to the optional characteristics, said unit can have means for recycling liquid sucked by the device for emptying towards said means for filling the container to capacity with said liquid product.

The invention shall be better understood when reading the following description accompanied with the single annexed drawing.

BRIEF DESCRIPTION OF THE DRAWINGS

FIG. 1 shows the carrying out of the method in accordance with the invention on a unit in accordance with the invention.

DETAILED DESCRIPTION OF THE INVENTION

The invention relates to a method for packaging a liquid product 1 in a container 2 with a low oxygen content. The liquid product 1 can be, but is not restricted to, a food product such as soup, beverage, juice, sauce or others.

The container 2 can be a metal tin such as a tin can, a bottle made in particular of glass, plastic or any other material. The container 2 has an opening 3 intended for its filling.

The method in accordance with the invention comprises the following steps:

- the air is removed from the container 2 by filling same to capacity with a liquid in a non-controlled atmosphere (ambient air),
- the full container 2 is placed in a non-oxidising atmosphere 4 formed by at least one non-oxidising gas,
- the liquid product is partially emptied from the container in a non-oxidising atmosphere, in such a way that said at least one non-oxidising gas replaces the said product in said container,
- said opening of the container is closed in a gas-tight manner, partially filled with said liquid product in a non-oxidising atmosphere.

"Filling to capacity" means the complete or almost complete filling of the internal volume of said container with said liquid product.

The non-oxidising atmosphere can be $N_2$, $CO_2$ or another non-oxidising gas, or a mixture of these gases.

According to an embodiment, the step of emptying the liquid product can be carried out by suction. According to another embodiment, the step of emptying can be carried out by turning the container over.

According to an embodiment, said emptying liquid is recycled as a filling liquid.

Such as is shown in FIG. 1, said liquid emptied from the container, in particular via suction, is recycled in order to serve as a filling liquid for the carrying out of another step of filling with a liquid product to capacity in a following container.

The step of closing said opening in a gas-tight manner can be carried out by the setting into place of a closure 5; such as a lid or a stopper. For example, in the case of a metal tin, the step of closing can consist in the setting in place of a lid on the opening of the metal tin, then the crimping of the lid to the metal tin.

According to another embodiment, the step of closing said opening of the container can be carried out by the setting into place of a stopper, in particular by force or a screwed stopper.

Advantageously, the method can be carried out on a continuous production unit 10.

As such, the invention further relates to a unit 10 for the packaging of liquid products 1 sensitive to oxygen, in a container 2 with a low oxygen content on a continuous production line, said container 2 having an opening 3.

Such as described hereinabove, the liquid can be a food product, such as soup, sauce, beverage or others. The container can be a metal tin or a bottle.

Said unit 10 comprises, according to the direction of forward movement of the containers, successively:

- means for filling 11 the container 2 with said liquid product 1 to capacity in a non-controlled atmosphere,
- a chamber 12 in a non-oxidising atmosphere, filled with a non-oxidising gas, said chamber being provided with means of conveying 13 allowing for the forward movement of containers, said chamber receiving a device for emptying 14 a container in particular via suction,
- a device for closing the opening 3 of said container in a gas-tight manner internal to said chamber.

The means for filling 11 the container with the liquid product to capacity can be comprised of a device for metering which delivers a dose corresponding to the internal volume of the container. These means of filling 11 are located in the free air and make it possible to remove the air from the container.

The chamber 12 can be comprised of a tunnel. The chamber 12 has means of nozzles of a non-oxidising gas. The interior volume of the chamber is therefore kept in a non-oxidising atmosphere, under slight overpressure, by the intermediary of these means of nozzles, thus preventing the insertion of air.

The containers 2 filled to capacity enter into the chamber 12 at one of the ends 6 of the chamber 12 and are displaced to the emptying device 14. This device for emptying 14 can be a suction device comprising a racking cock 15, actuated downwards or upwards by means of an actuator such as a cylinder. In low position, the racking cock 15 is plunged into the liquid of the container. The emptying is carried out by suction of the liquid in particular thanks to a pump of the device 14. The sucked liquid can be recycled towards said means for filling 11 for the filling of a following container.

The device for closing in a gas-tight manner the opening of the container can be:

- in the case of a metal tin, a device allowing for the setting into place of a lid (metal) and the crimping of the lid to said metal tin,
- in the case of a bottle, a device allowing for the putting into place of a stopper (by force or screwed in particular).

Note that the applicant filed, on the same day, a patent application for a method for packaging products, in particular food products sensitive to oxygen specially intended for the packaging of non-liquid products, which also comprises, as a general principle, the fact of filling the container to capacity in order to remove the air from the container, place the container in a non-oxidising atmosphere, and empty the liquid partially from the container, before closing the container in a gas-tight manner.

Naturally, other embodiments could have been considered par those skilled in the art, without however leaving the scope of the invention defined by the claims hereinafter.

The invention claimed is:

1. A method for packaging a liquid product in a container with a low oxygen content, said container having an opening said method comprising the following steps:

- removing air from the container by filling the container to capacity with a liquid in a non-controlled atmosphere,
- placing the container filled with liquid product to capacity in a non-oxidising atmosphere formed by at least one non-oxidising gas,
- partially emptying the liquid product from the container in the non-oxidising atmosphere so that said at least one non-oxidising gas replaces said liquid product emptied from said container,
- closing said opening of the container in a gas-tight manner so that the container is partially filled with said liquid product in a non-oxidising atmosphere.

2. The method according to claim 1, wherein the step of partially emptying the liquid product is carried out via suctioning of the liquid product from the container.

3. The method according to claim 2, wherein said liquid product emptied is recycled as a filling liquid.

4. The method according to claim 1, wherein said liquid product emptied is recycled as a filling liquid.

5. The method according to claim 1, wherein the steps of the method are carried out on a continuous production unit.

6. The method according to claim 1, wherein the step of closing said opening of the container in a gas-tight manner comprises setting into place of a closure.

7. The method according to claim 6, wherein the closure is a stopper or a lid.

8. The method according to claim 1, wherein the container is a metal tin or a bottle.

9. The method according to claim 8, wherein the container is a tin can.

10. The method according to claim 8, wherein the container is a bottle made of glass or plastic.

11. The method according to claim 1, wherein said liquid product is a food product.

12. The method according to claim 1, wherein the liquid product is an oxygen sensitive product.

13. A unit (10) for the packaging of a liquid product (1), in a container (2) with a low oxygen content, on a continuous production line, said container (2) having an opening (3), said unit comprising, according to a direction of forward movement of the container through the unit, successively:

- means for filling (11) the container with said liquid product to capacity in a non-controlled atmosphere,
- a chamber (12) filled with an inert gas, providing a non-oxidising atmosphere in said chamber, said chamber being provided with means of conveying (13) allowing for forward movement of said container (2),
- an emptying device (14) for emptying the container filled with liquid product by suction, said emptying device extending into the said chamber, and
- a device for closing the opening of said container in a gas-tight manner while said container is in the chamber (12).

14. The unit according to claim 13, further comprising means for recycling (16) the liquid product emptied from the container by the suction of the emptying device (14) towards said means for filling (11) the container with said liquid product to capacity.

* * * * *